US007331259B1

(12) United States Patent
Chen

(10) Patent No.: US 7,331,259 B1
(45) Date of Patent: Feb. 19, 2008

(54) RATCHET WRENCH

(76) Inventor: Yi-Fu Chen, No. 22, Lane 427, Dasheng Street, Taichung City 408 (TW)

( * ) Notice: Subject to any disclaimer, the term of this patent is extended or adjusted under 35 U.S.C. 154(b) by 0 days.

(21) Appl. No.: 11/645,348

(22) Filed: Dec. 26, 2006

(51) Int. Cl.
*B25B 13/46* (2006.01)
*B25B 17/00* (2006.01)
*B25B 13/00* (2006.01)

(52) U.S. Cl. ..... 81/63; 81/57; 81/58.1

(58) Field of Classification Search ..... 81/63, 81/57.3, 58.1, 54
See application file for complete search history.

(56) References Cited

U.S. PATENT DOCUMENTS 1,032,871 A * 7/1912 Bancroft ..... 81/62
2,530,553 A * 11/1950 Strobell ..... 81/57.46
3,283,621 A * 11/1966 Faso ..... 81/54
4,184,390 A * 1/1980 Evans ..... 81/57.3
4,566,356 A * 1/1986 Herota ..... 81/62
5,144,869 A * 9/1992 Chow ..... 81/63
5,501,124 A * 3/1996 Ashby ..... 81/58.2
5,622,089 A * 4/1997 Gifford, Sr. ..... 81/62
6,065,374 A * 5/2000 Taggart ..... 81/63.2
6,079,532 A * 6/2000 Marks ..... 192/43
6,910,402 B2 * 6/2005 Drzewiecki ..... 81/57.17
2003/0031913 A1 * 2/2003 Pavio et al. ..... 429/34
2005/0166714 A1 * 8/2005 Fowler ..... 81/57.3

* cited by examiner

*Primary Examiner*—Joseph J. Hail, III
*Assistant Examiner*—Alvin J Grant

(57) ABSTRACT

The present invention relates to a ratchet wrench including a wrench with one end provided with a pivot hole; a turning knob disposed in the pivot hole of the wrench and containing a dial; a wheel member disposed to the handle of the wrench and containing also a dial; and a turning member with one end disposed to the dial of the turning knob and another end disposed to the dial of the wheel member.

1 Claim, 14 Drawing Sheets

RATCHET WRENCH

BACKGROUND OF THE INVENTION

1. Field of the Invention

The present invention is related to a ratchet wrench, and more particularly, to an adjustment for rotation direction disposed on the neck of the handle of the wrench.

2. Description of the Prior Art

A dial 92 is pivoted to a wrench 91 and a mechanism allowing positive and reverse rotation is disposed in one end of the head of the wrench 16 of the prior art as illustrated in FIG. 16 of the accompanying drawings. Upon turning the dial 92 for a certain degree, the dial 92 switches internal elements in the wrench to turn clockwise or counter-clockwise. However, the prior art fails to provide convenient operation since a user must have his palm of the hand to approach the dial 92 to turn it. Furthermore, the efficiency of executing rapid switch of the operating direction of the wrench is compromised because that the user after having changed the holding position of the wrench has to return his hand to the original position on the handle.

SUMMARY OF THE INVENTION

A ratchet wrench including a wrench with one end provided with a pivot hole; a turning knob disposed in the pivot hole of the wrench and containing a dial; a wheel member disposed to the handle of the wrench and containing also a dial; and a turning member with one end disposed to the dial of the turning knob and another end disposed to the dial of the wheel member.

DETAILED DESCRIPTION OF THE PREFERRED EMBODIMENTS

Figure 1:
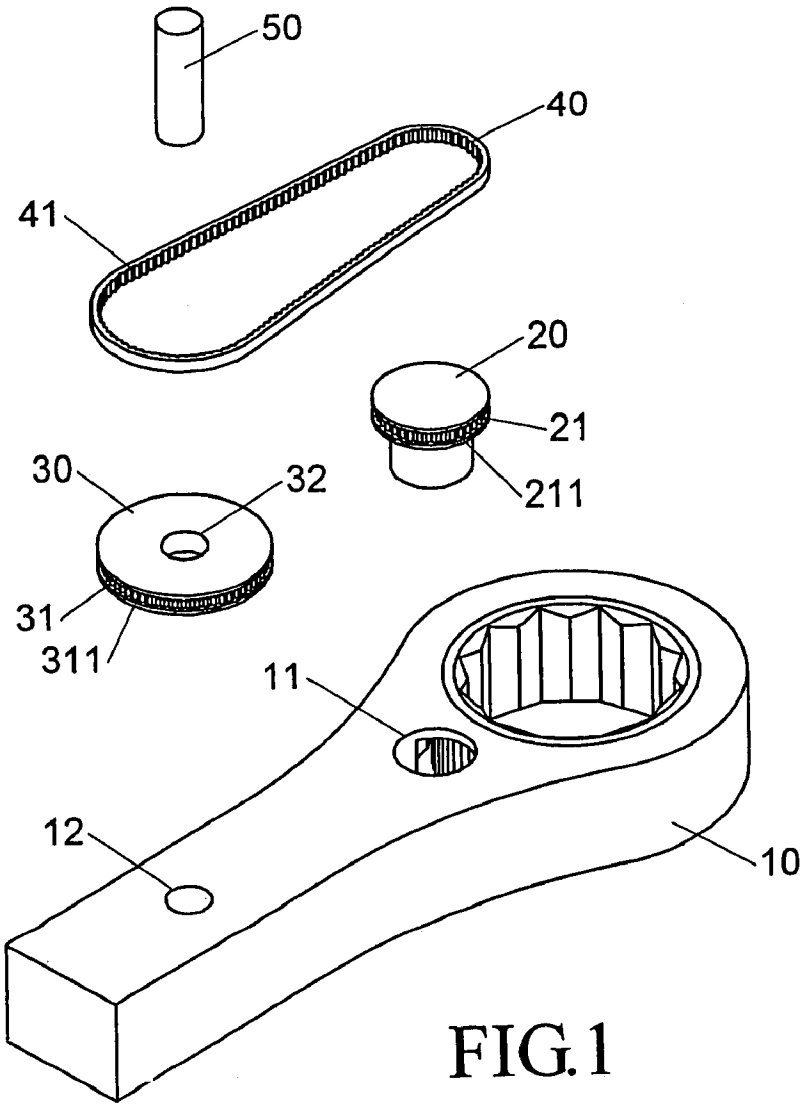
FIG. 1 is an exploded perspective view of a first preferred embodiment of the present invention.

Referring to FIG. 1, a ratchet box end wrench includes a wrench 10 provided with at one end a pivot hole 11 and a pinhole 12; a turning knob 20 comprised of a dial 21 and a toothed shoulder 211 is pivoted in the pivot hole 11 of the wrench 10 to control multiple internal elements in the wrench 10 to engage positive or reverse turning; a wheel member 30 disposed in the pinhole 12 on the wrench 10 and made a central hole 32 in the same diameter as that of the pinhole 12 is comprised of a wheel dial 31 and a toothed shoulder 311; a turning member 40 having a toothed inner circumference 41 is provided with on end engaged to the toothed shoulder 211 of the turning knob 20 and another end engaged to the tooth shoulder 311 of the wheel member 30 linked to the turning member 40 to drive the turning knob 20; and a pin 50 inserted into the central hole 32 of the wheel member 30 to pivot the wheel member 30 into the pin hole on the wrench 10.

Figure 2:
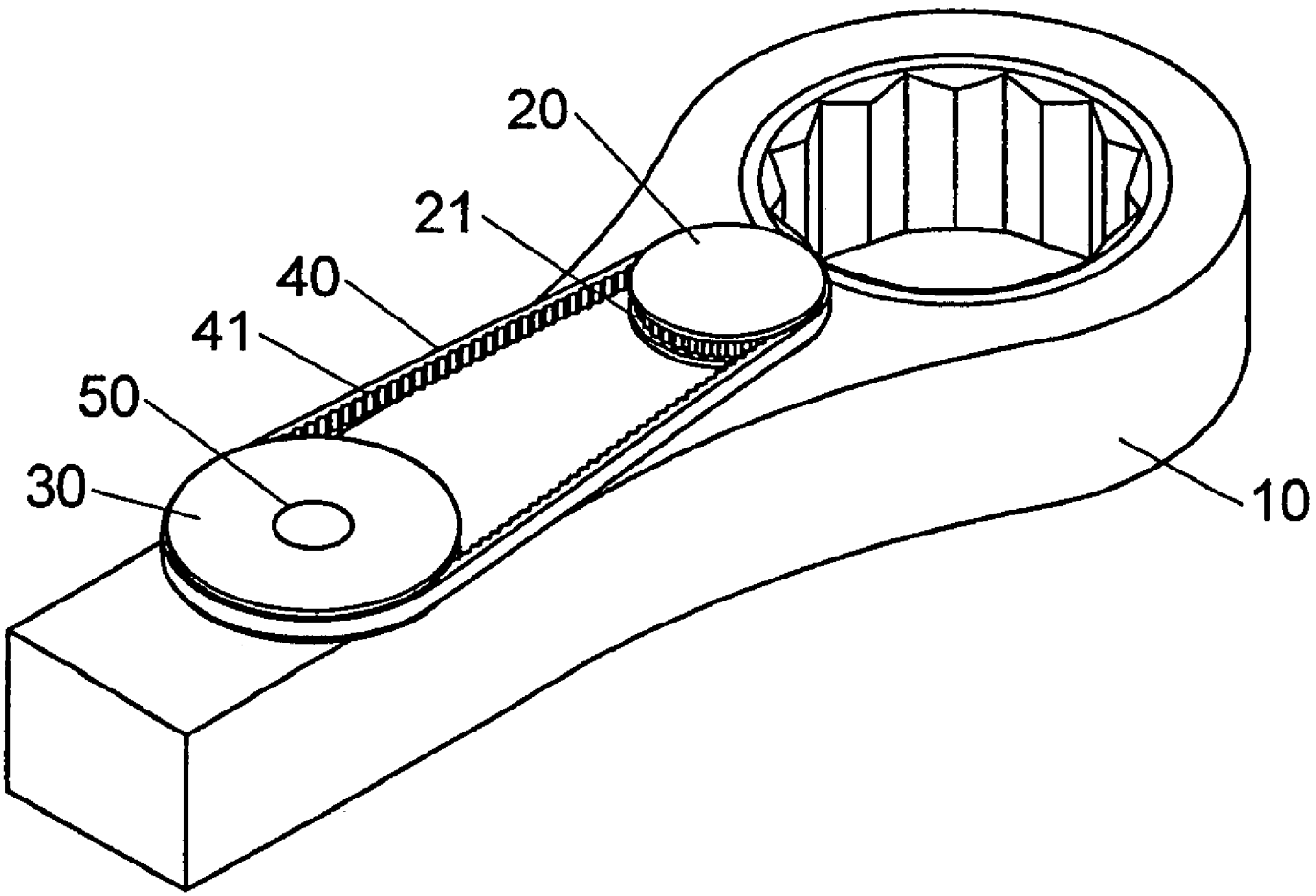
FIG. 2 is an exploded view of the first preferred embodiment of the present invention.

As illustrated in FIG. 1, the turning knob 20 is pivoted into the pivot hole 11; the wheel member 30 is pivoted to the pinhole 12, and the turning member 30 is inserted onto both of the turning member 20 and the wheel member 30. The tooth inner circumference 41, the toothed shoulder 211 of the turning member and the toothed shoulder 311 of the wheel member 30 are engaged to one another. As the wheel member 30 is linked to the turning member 40, the turning knob 20 is driven when the wheel member 30 is turned. Accordingly, the user switches between the positive and reverse operation by turning the wheel member 30 without leaving the original holding position on the handle of the wrench 10 as illustrated in FIG. 2 showing a perspective view of the preferred embodiment of the present invention as assembled.

Figure 3:
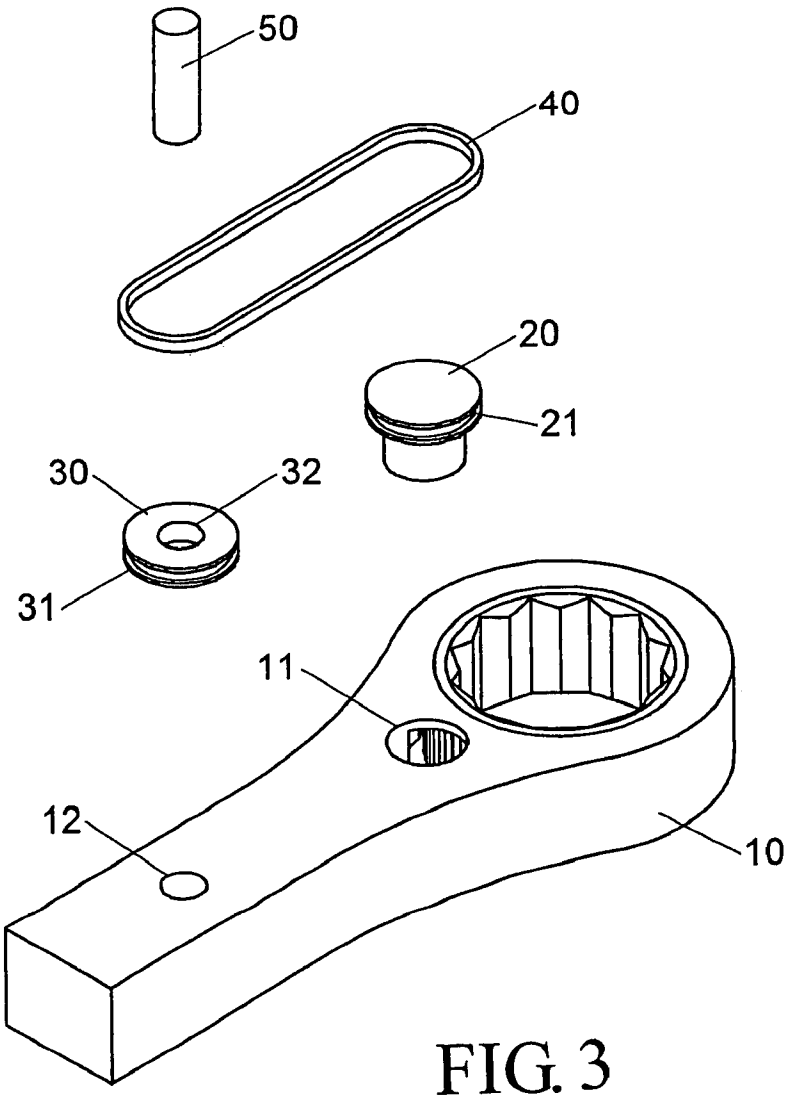
FIG. 3 is an exploded perspective view of a second preferred embodiment of the present invention.

In a second preferred embodiment of the present invention as illustrated in FIG. 3, both toothed shoulders 211, 311 respectively of the turning knob 20 and the wheel member 30 are provided with recessed slots to receive the turning member 40 so that all the turning knob 20, the turning member 40 and the wheel member 30 are coupled to one another.

Figure 4:
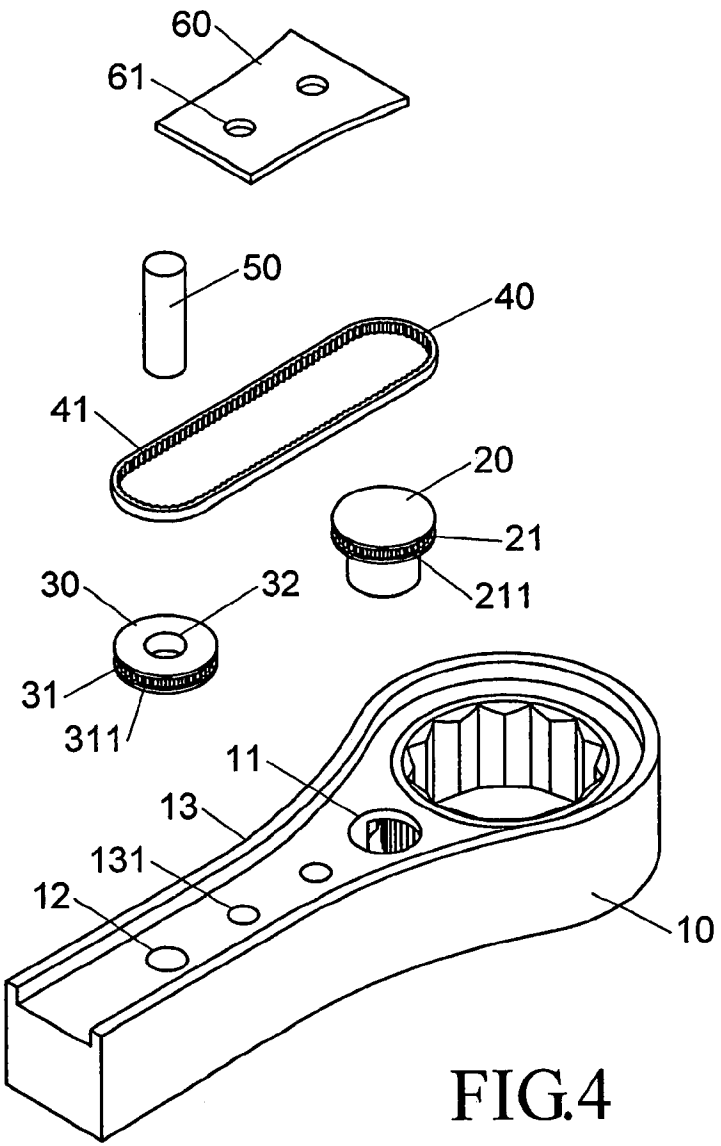
FIG. 4 is an exploded perspective view of a third preferred embodiment of the present invention.

In a third preferred embodiment of the present invention as illustrated in FIG. 4, a locating skirt 13 surrounding the outer circumference of the wrench 10 is fixed to the handle of the wrench 10 and two screw holes 131 are disposed at where between the pinhole 12 and the pivot hole 11 on the handle of the wrench 10. A plate 60 provided with two holes 61 covers upon the locating skirt 13. The turning knob 20, the wheel member 30, and the turning member 40 are disposed on the wrench 10; the plate 60 covers upon the locating skirt 13 on the wrench 10 and is secured to the wrench 10 by screwing two fasteners into their respective screw holes 131 through both holes 61.

Figure 5:
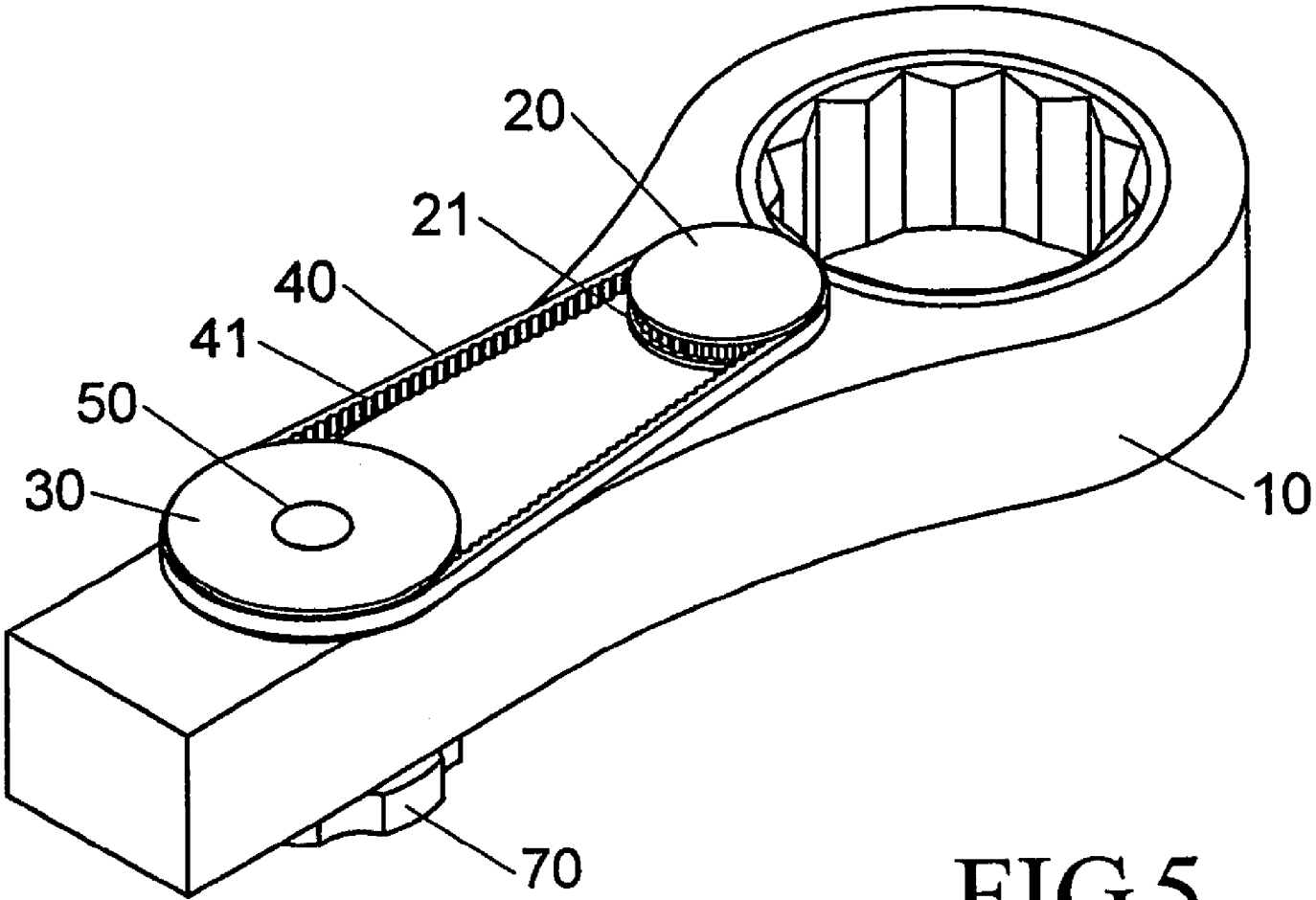
FIG. 5 is an exploded perspective view of a fourth preferred embodiment of the present invention.

A second wheel member 70 is provided on the other side of the wheel member 30 in a fourth preferred embodiment of the present invention as illustrated in FIG. 5. Wherein, a pin 50 penetrates through the wheel member 30 and the second wheel member 70 into the pin hole 12 on the wrench 10 so to achieve the purpose of switching between positive and reverse operation of the wrench 10 by turning the second wheel member 70 to drive the wheel member 30, the turning member 40, and thus the turning knob 20.

Figure 6:
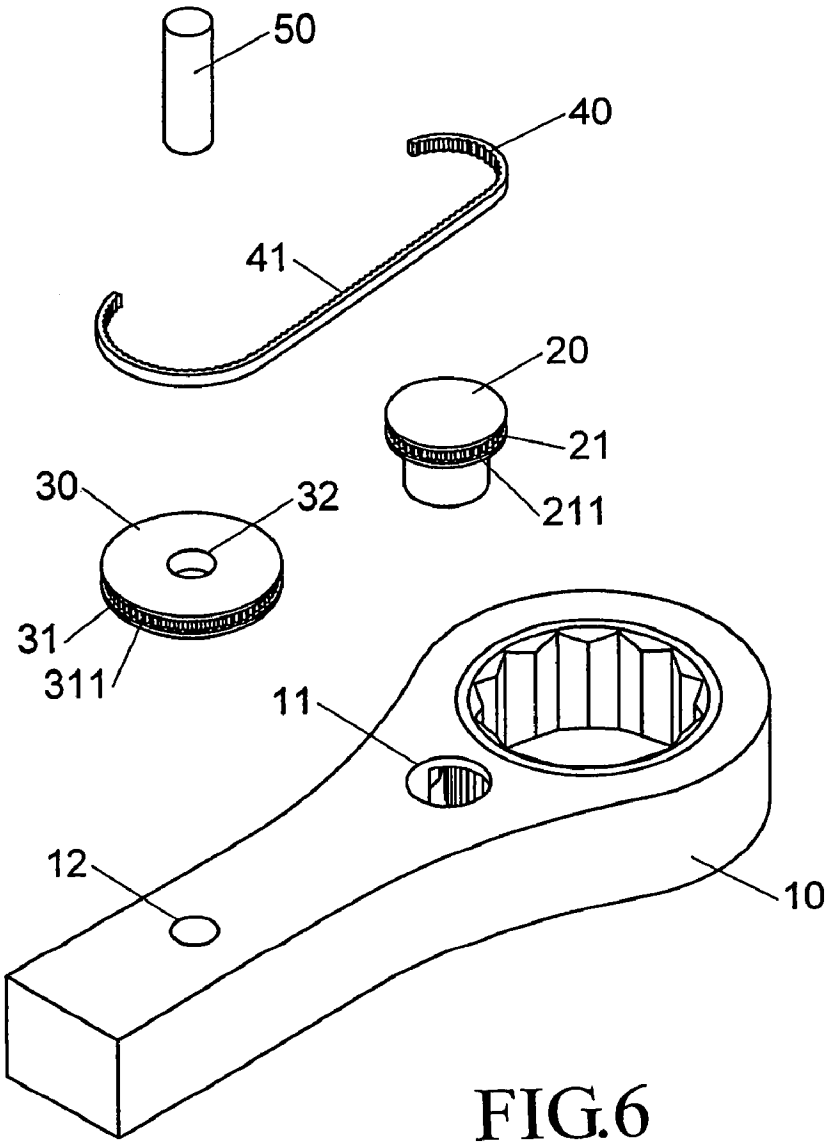
FIG. 6 is an exploded perspective view of a fifth preferred embodiment of the present invention.

As illustrated in FIG. 6, the turning member 40 in a fifth preferred embodiment of the present invention is not made in a closed form. One end of the turning member 40 is disposed on the turning knob 20 and engaged with the toothed shoulder 211 of the turning knob 20 while the other end is disposed on the wheel member 30 and engaged with the toothed shoulder 311 of the wheel member 30. Whereas the wheel member 30 is linked to the turning member 40, turning the wheel member 30 will drive the turning knob 20.

Figure 7:
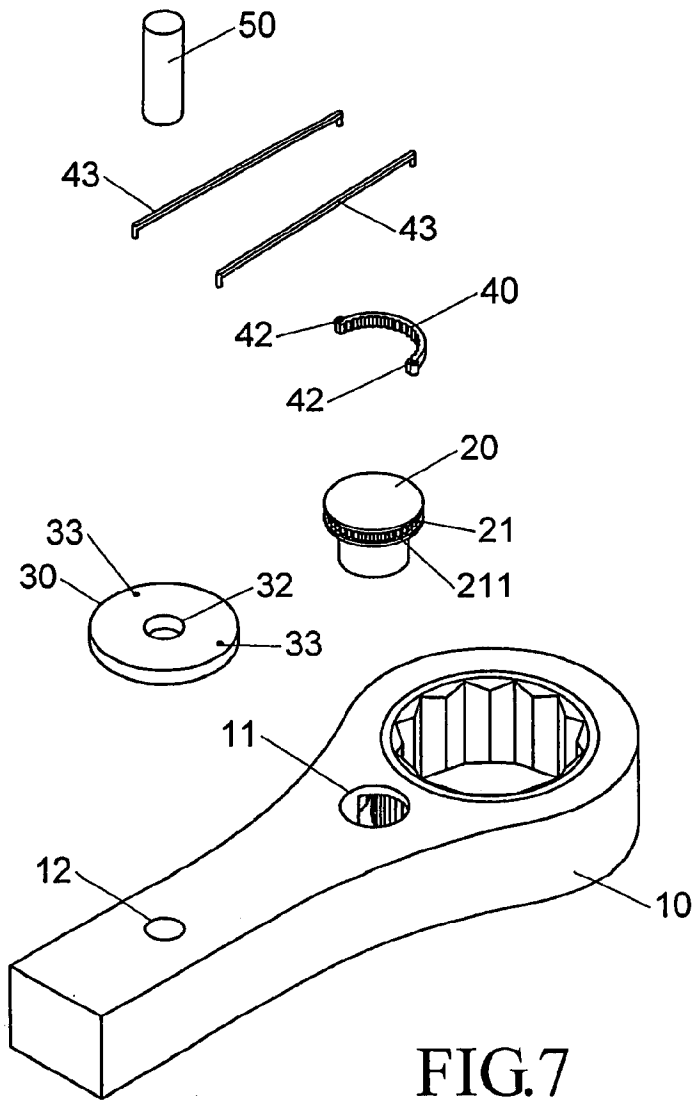
FIG. 7 is an exploded perspective view of a sixth preferred embodiment of the present invention.
Figure 8:
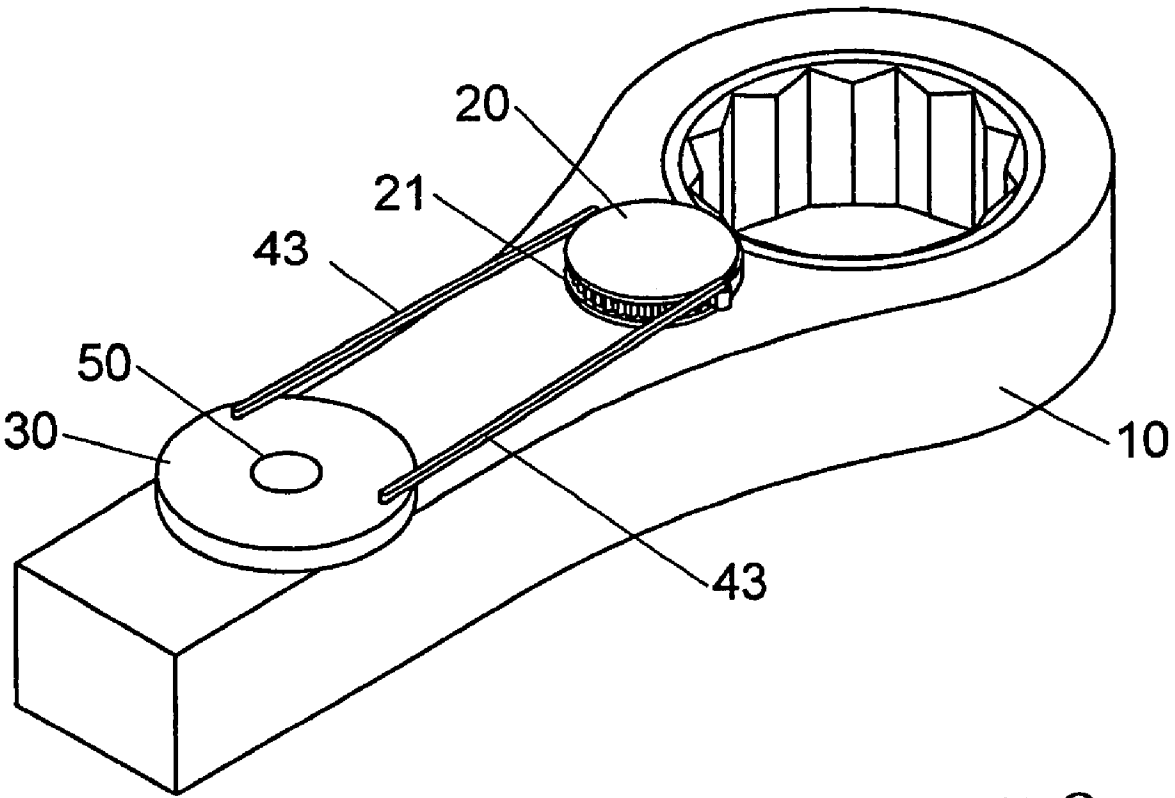
FIG. 8 is an exploded view of the sixth preferred embodiment of the present invention.

The turning member 40 indicates a half-moon shape in a sixth preferred embodiment of the present invention as illustrated in FIG. 7. Wherein, a toothed shoulder 41 on the semi-spherical inner side of the turning member 40 circles around the turning knob 20. Each of both ends 42 of the turning member 40 is connected with a cord 43 and another end of the cord 43 is disposed to a locking hole 33 disposed on the wheel member 30. When the wheel member 30 is turned, the cord 43 linked to the wheel member 30 pulls the turning member 40 to drive the turning knob 20 to turn clockwise or counter-clockwise as desired. FIG. 8 shows a view of the sixth preferred embodiment as assembled.

Figure 9:
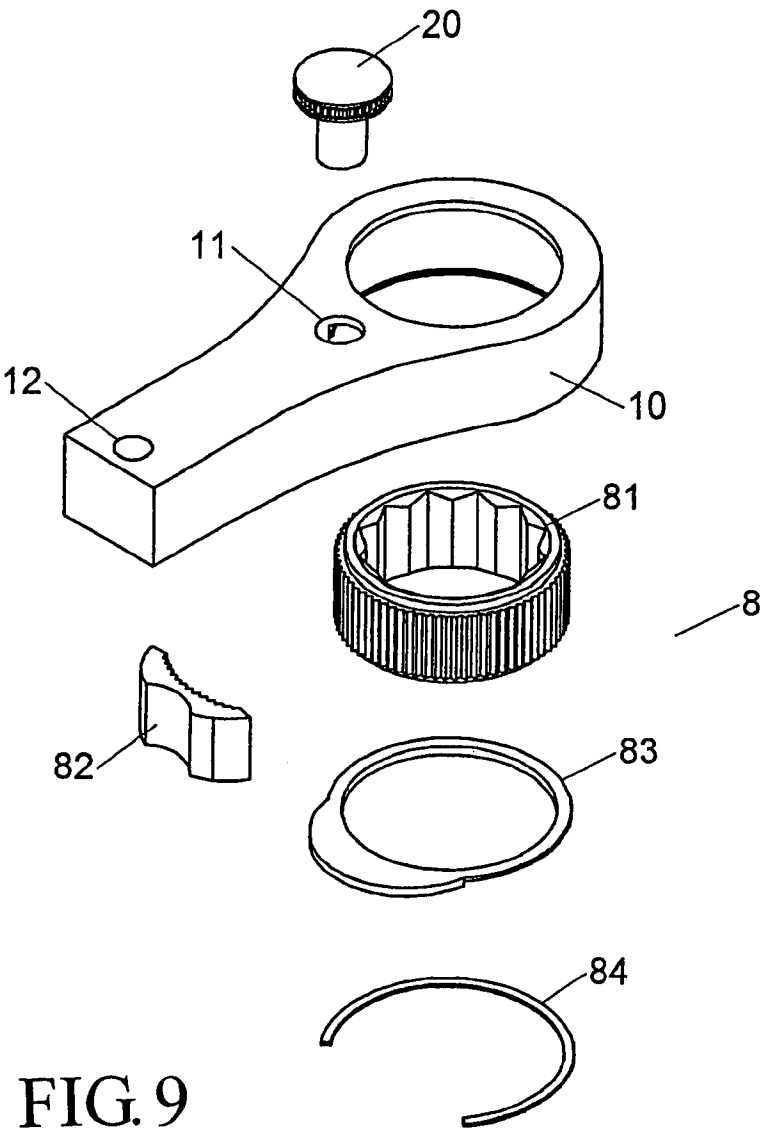
FIG. 9 is an exploded perspective view of a seventh preferred embodiment of the present invention.
Figure 10:
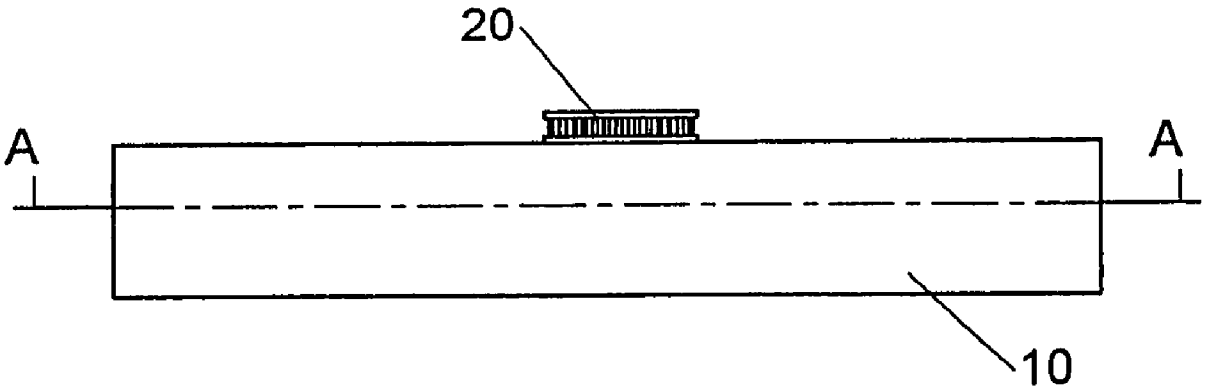
FIG. 10 is a side view of the seventh preferred embodiment of the present invention.
Figure 11:
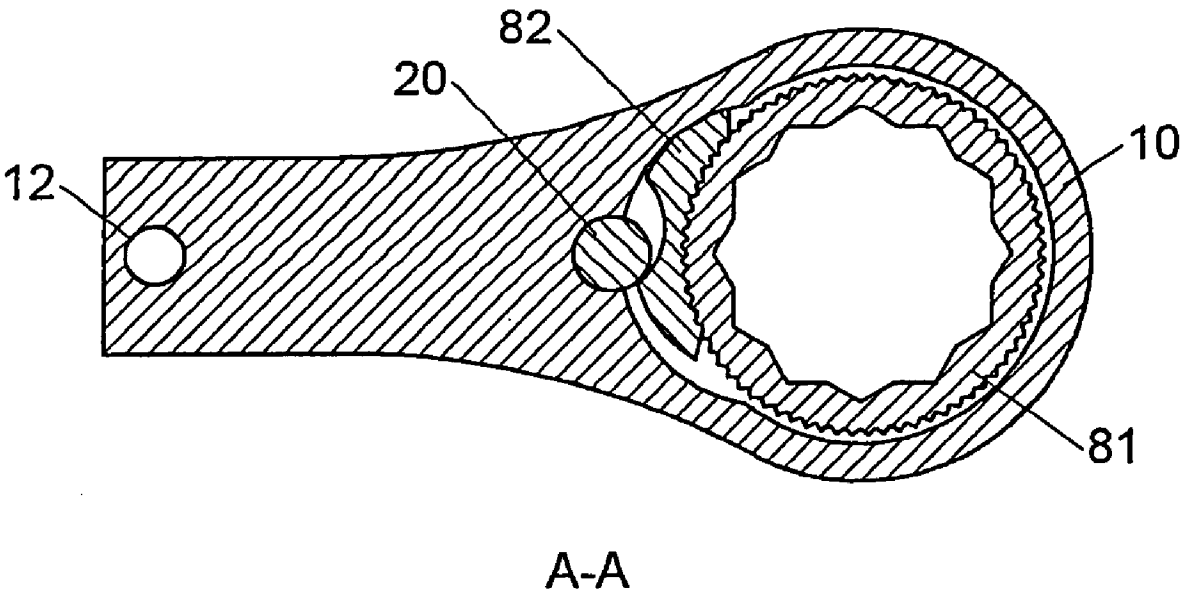
FIG. 11 is a sectional view of A-A taken from FIG. 10.

Now referring to FIG. 9 for a seventh preferred embodiment of the present invention, a ratchet structure 8 in the wrench 10 includes a ratchet 81, a limit gear 82, a lid 83, and a locking ring 84 disposed in the wrench 10 in sequence; and the adjustment between the positive and the reverse operation is achieved by turning the turning knob to activate the limit gear 82 to move in the wrench 10. FIG. 10 shows the seventh preferred embodiment as assembled and FIG. 11 shows a sectional view of A-A taken from FIG. 10.

Figure 12:
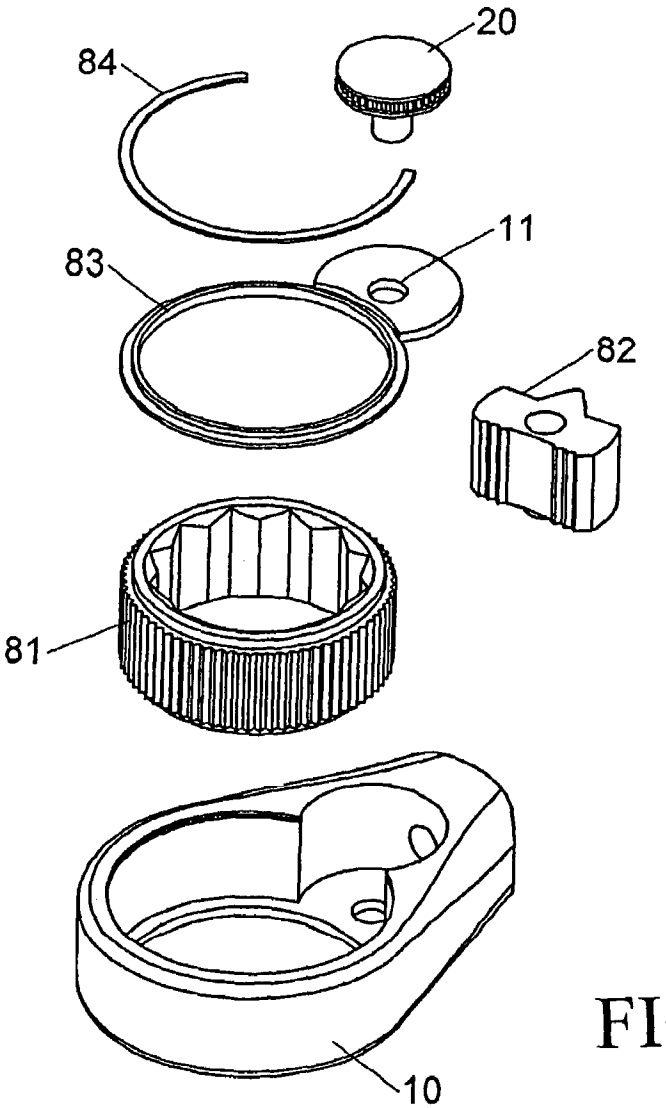
FIG. 12 is an exploded perspective view of an eighth preferred embodiment of the present invention.
Figure 13:
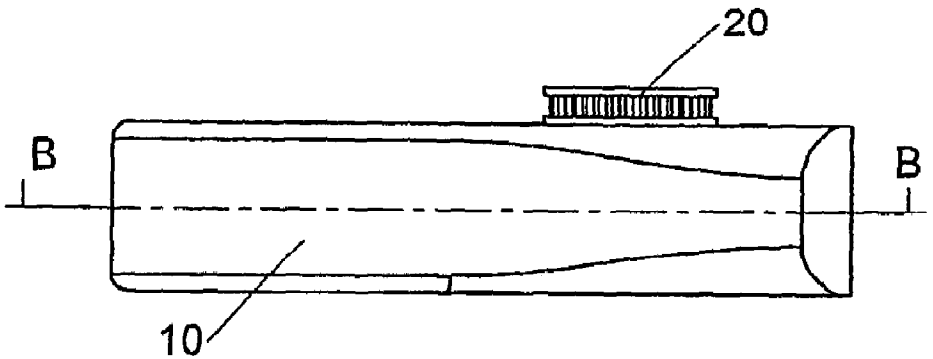
FIG. 13 is a side view of the eighth preferred embodiment of the present invention.
Figure 14:
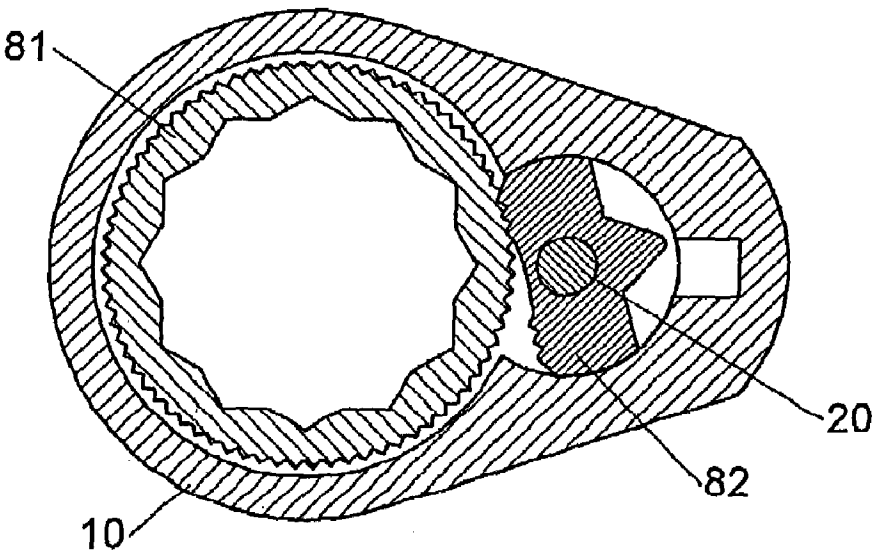
FIG. 14 is a sectional view of B-B taken from FIG. 13.
Figure 15:
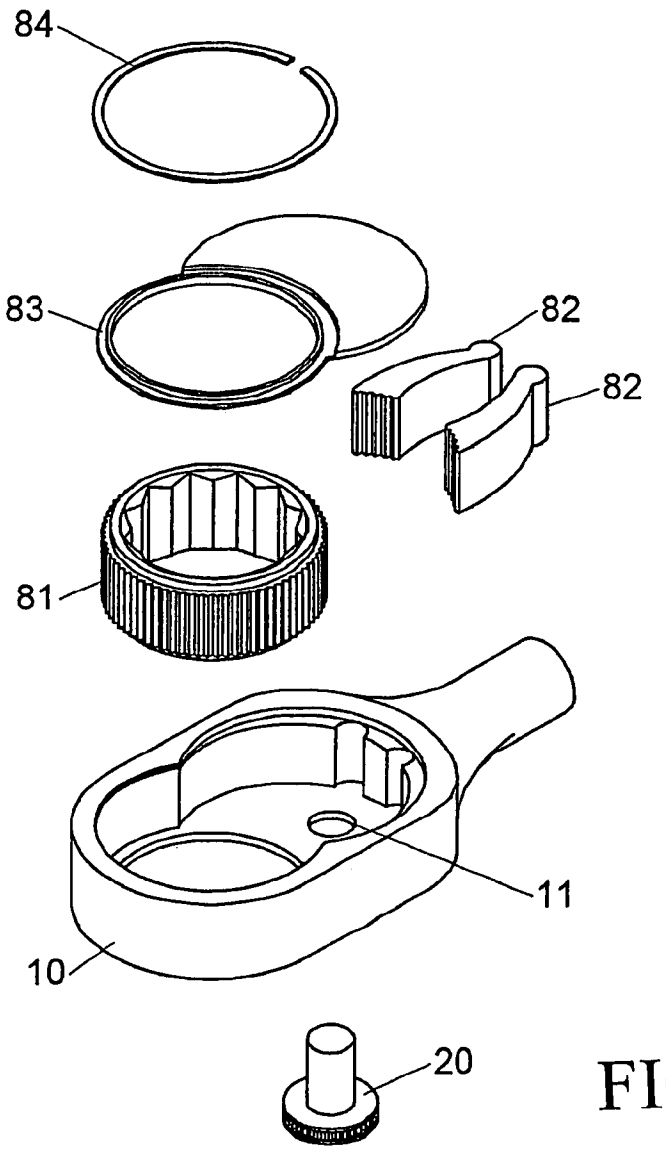
FIG. 15 is an exploded perspective view of a ninth preferred embodiment of the present invention.
Figure 16:
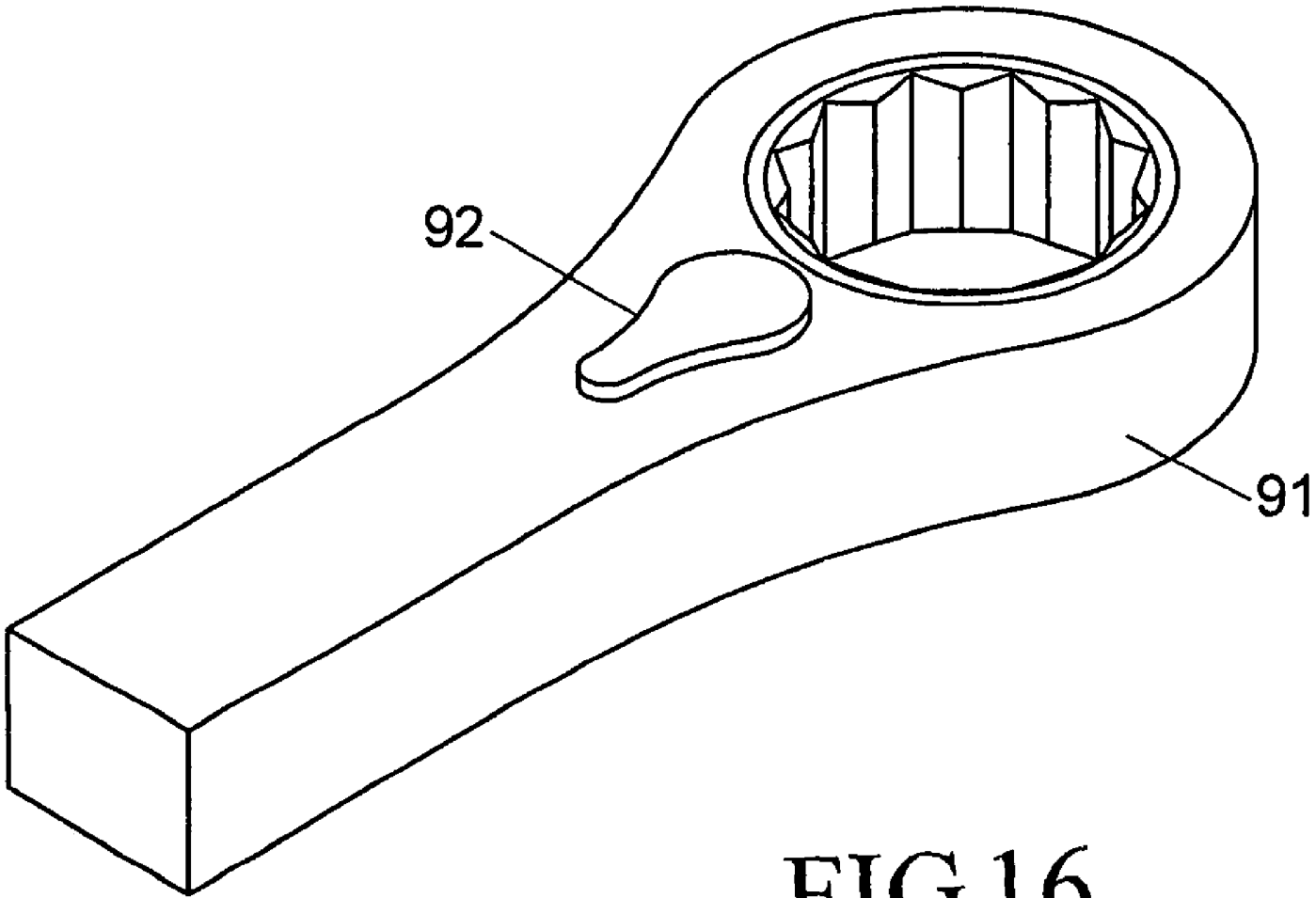
FIG.16 PRIOR ART
FIG. 16 is a perspective view of a ratchet box end wrench of the prior art.

In an eighth preferred embodiment of the present invention as illustrated in FIG. 12, the ratchet structure 8 in the wrench 10 is provided in the wrench 10 in sequence the ratchet 81, a limit gear 82, the lid 83 disposed with a pivot hole 11, and the locking ring 84; the turning knob 20 is pivoted to the pivot hole 11 and fixed to the limit gear 82; and one end of the limit gear 82 is engaged to the ratchet 81 and another end holding against the inner edge of the wrench 10 to achieve the same purpose of adjusting for positive or reverse operation. FIG. 13 shows the seventh preferred embodiment as assembled and FIG. 14 shows a sectional view of B-B taken from FIG. 13.

Furthermore, as illustrated in FIG. 9 for a ninth preferred embodiment of the present invention, the ratchet structure 8 in the wrench 10 is comprised of the ratchet 81, two symmetrically arranged limit gears 82, the lid, and the locking ring 84 disposed in the wrench 10 in sequence; the turning knob 20 is pivoted to the pivot hole 11. One limit gear 82 is engaged to the ratchet by operating the turning knob 20 while another limit gear 82 is disengaged from the ratchet 81 for achieving the purpose of adjusting for positive or reverse operation.

It is to be noted that the ratchet structure 8 of the present invention is not limited to those disclosed in the preceding three preferred embodiments.

In the present invention, the dial 21 of the turning knob 20 is provided with the toothed shoulder 211; and the wheel dial 31 of the wheel member 30 is also disposed with the toothed shoulder 311. Generally, both of the upper and the lower ends of both dials 21, 31 may be each provided with a flange, i.e., indicating a concavely cross section so to receive the turning member 40 upon surrounding each dial 21, 31 to avoid the turning member 40 from falling off.

The turning member 40 in the present invention may be related to a belt or a chain with its tooth form to allow it to be engaged with the turning knob 20 and the wheel member 30.

Both of the turning knob 20 and the turning member 30 in the present invention may be each related to a gear.

The present invention provides better operating performance since both of the wheel member 30 and the turning member 40 are within the reach of the handle of the wrench 10 where held by the user to directly change the turning direction without moving the hand.

What is claimed is:

1. A ratchet wrench including:

a wrench with one end provided with a pivot hole;

a turning knob disposed in the pivot hole of the wrench and formed with a dial;

a wheel member being connected to the wrench and including a dial thereon and a locking hole therein;

a turning member with a first end connected to the dial of the turning knob and a second end connected to the dial of the wheel member, wherein the turning member is a crescent element with a semi-spherical internal side for surrounding the turning knob; and two cords each including an end attached to and wound on a related one of the ends of the turning member and another end fit in the locking hole of the wheel member.

* * * * *